US005330263A

United States Patent [19]

Wilkinson

[11] Patent Number: 5,330,263

[45] Date of Patent: Jul. 19, 1994

[54] MULTIPLE PURPOSE MOBILE STORAGE CABINET

[76] Inventor: William T. Wilkinson, Box 772, Crownsville, Md. 21032

[21] Appl. No.: 1,509

[22] Filed: Jan. 6, 1993

[51] Int. Cl.[5] ..... A47B 88/00; A47B 81/00; A47F 5/02; D06F 53/00

[52] U.S. Cl. ..... 312/328; 312/287; 312/249.8; 211/119.07; 211/166

[58] Field of Search ..... 312/317.1, 317.2, 321.5, 312/326-328, 351.3-351.7, 351.11, 287, 249.8; 211/197, 166, 119.01-119.07, 190, 196; 248/245-246; 104/88-91

[56] References Cited

U.S. PATENT DOCUMENTS

| | | | |
|---|---|---|---|
| 423,196 | 3/1890 | Waller | 312/327 X |
| 3,016,277 | 1/1962 | Griffin | 312/287 |
| 3,759,398 | 9/1973 | Romney | 211/163 X |
| 3,868,906 | 3/1975 | Cameron | 104/89 |
| 3,927,923 | 12/1975 | Kimmel | 312/252 |
| 4,577,767 | 3/1986 | Geschwender | 211/190 |
| 4,802,596 | 2/1989 | Steiner | 211/197 |
| 4,807,837 | 2/1989 | Gawlik et al. | 211/196 X |
| 4,935,155 | 6/1990 | Steiner | 211/119.01 X |

*Primary Examiner*—Kenneth J. Dorner
*Assistant Examiner*—Nancy Mulcare
*Attorney, Agent, or Firm*—Charles S. Knothe

[57] ABSTRACT

A device for the temporary storage of clothing articles with a base unit consisting of a top having an opening in the center, a bottom and four sides of which the two opposite sides are solid and the sides adjacent to those have openings of varying sizes and a hinged storage bin which is positioned in one of the openings in one of the four sides of the base cabinet. A fitting is set into the opening of the top surface in which a tube fits. A frame with a plurality of hooks is attached to top end of the tube. A plurality of bars are arranged in the open side of the base unit at different elevations in relation to the bottom of the base unit allowing for the storage of foot wear articles.

5 Claims, 4 Drawing Sheets

MULTIPLE PURPOSE MOBILE STORAGE CABINET

BACKGROUND OF INVENTION

The present invention addresses the need for the temporary storage and organization of clothing articles and other household items. Various devices have been disclosed in the prior art such as clothing trees, valets, clothes hampers, shoe racks, etc. These devices satisfy the needs of the user for the temporary storage of clothing articles. However, each device addresses a separate storage issue. The present invention is intended to be an all in one device for the temporary storage of virtually any article clothing.

During the evening, this device affords a storage container for soiled clothing, a sloped rack for the storage of shoes and a rectangular frame with hooks for hanging articles. The top surface is an excellent area for men to empty their pockets and can even be used to provide an additional area for the storage of toiletry articles.

Today's exercise and health conscience individuals will find the clothing rack particularly useful. Persons who jog or exercise and then shower and dress for work or dinner can use the Clothing Rack to store their street clothing during exercise periods. After exercising, jogging shoes, exercise suits and such can be stored on the Clothing Rack until the next period of exercise.

Further, this device can be used in the laundry room, kitchen, laundry, shop/garage, and pool/terrace for the storage and organization of items used in those areas of the home. Also, it can be used for the storage of refuse which is of current concern.

SUMMARY OF INVENTION

The present invention discloses a device for the storage of clothing articles, shoes, etc. A frame with hooks provides a place for the storage of hanging articles. Clothing articles can be placed directly on the hooks or hangers can be used in conjunction with the rectangular framed rack. The framed rack can be fixed in a stationary position or can be made to rotate or adjust in its height above the floor or both. A tip-out storage bin provides the functionality of a clothes hamper for the storage of soiled clothing. A sloped rack or plurality of bars provide for the temporary storage of dress shoes, slippers, jogging shoes and other footwear. The top of the device can be used for the overnight storage of pocket change, wallet, watch and such. The sides can remain flush with the top surface or can extend beyond the top to form a lip to prevent items from sliding or rolling off top. The base unit can be set on stationary feet or furnished with wheeled casters allowing for a degree of mobility.

DETAILED DESCRIPTION OF THE DRAWINGS

Figure 1:
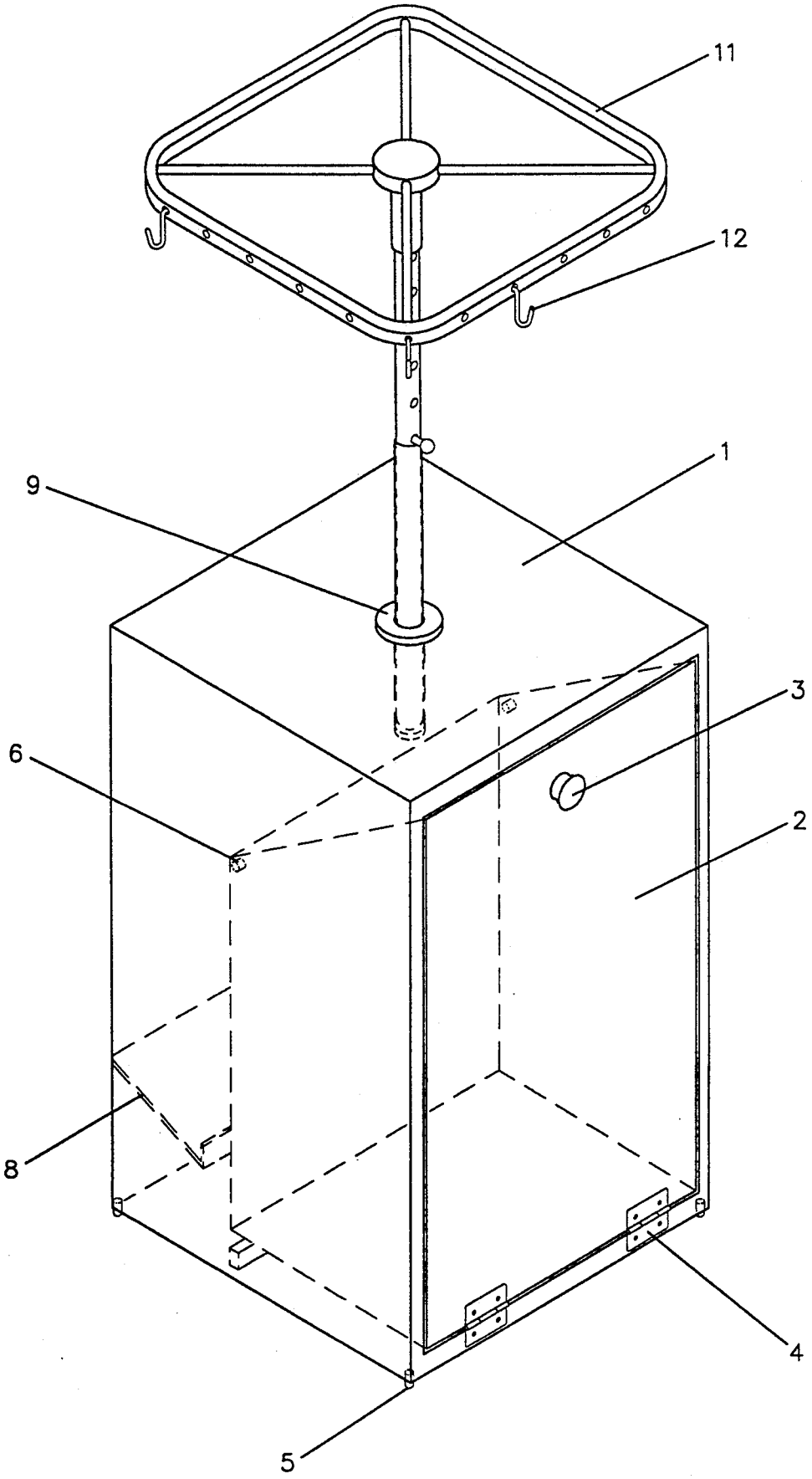
FIG. 1 is a perspective view showing the device with the rack in a fixed height.

FIG. 1 shows the device in a perspective view. The base unit (1) consists of four sides, a top and a bottom. A storage container (2) with a knob (3) is positioned in the base unit (1). A plurality of hinges (4) are attached to the bottom of the storage container (2) and the base unit (1) and arranged to permit the storage container (2) to rotate and tip-out of the base unit (1). Pins (6) positioned along the top of the storage bin provide a means of stopping the rotation of the storage bin (2) and prevent the storage bin (2) from tipping out of the base unit (1). A fitting (9) having an internal surface and a flange is positioned in an opening in the top of the base unit (1) such that the flange rests on and is attached to the top surface of the base unit (1). A tube (10) is placed in a vertical position inside the fitting (9). The height of the tube (10) is adjustable by the insertion of a pin through the tube (10). A frame (11) with a plurality of hooks (12) is attached to the opposite end of the tube (10). A sloped shelf (8) is arranged in the open side of the base unit (1) for the storage of foot wear articles. Fixed feet (5) are attached to the bottom of the base unit (1).

Figure 2:
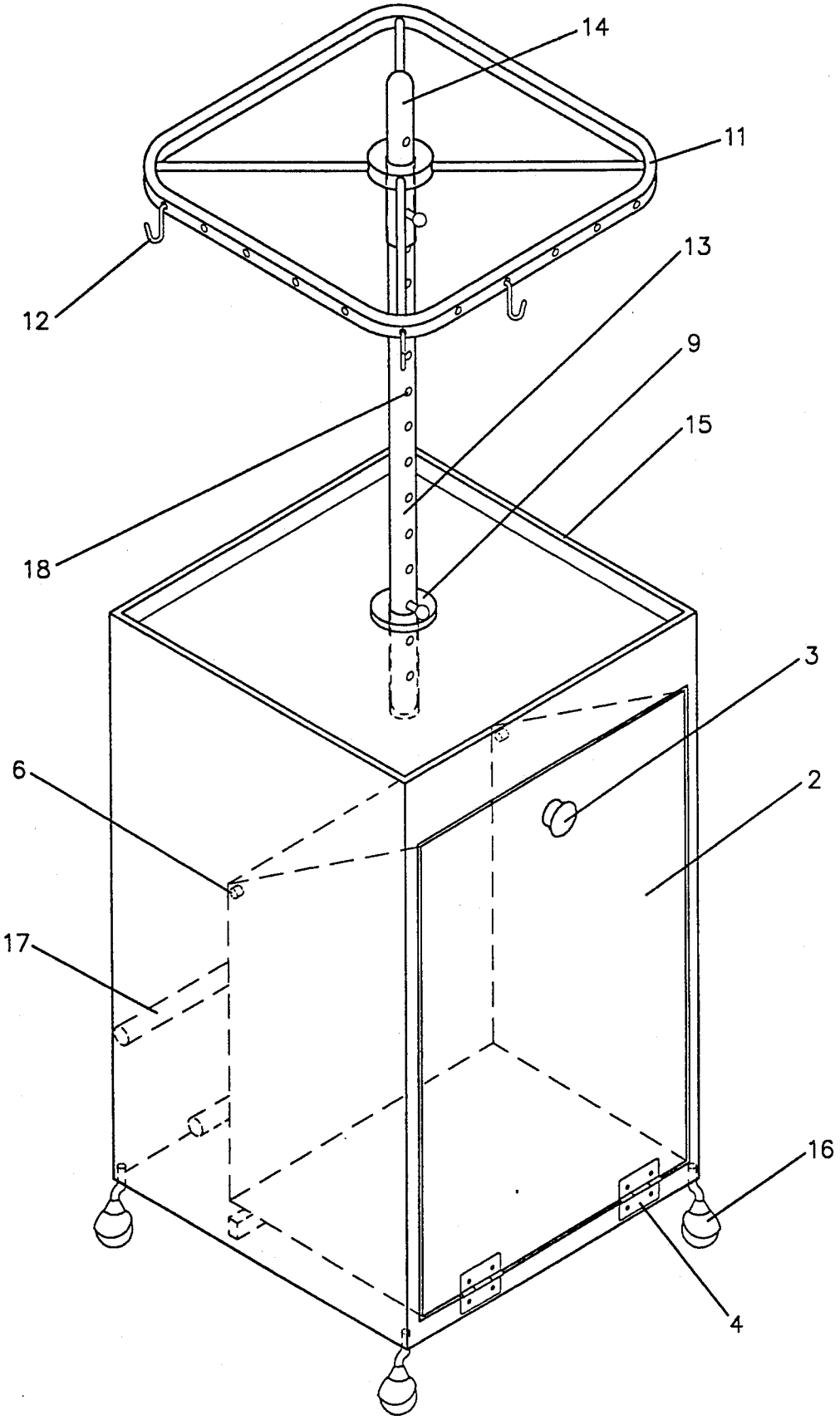
FIG. 2 is a perspective view showing the device with the rack capable of adjustment.

FIG. 2 shows the device in a perspective view. The base unit (1) consists of four sides, a top and a bottom. The sides of the base unit (1) are extended or have extensions (15) to prevent items from rolling or sliding off the top. A storage container (2) with a knob (3) is positioned in the base unit (1). A plurality of hinges (4) are attached to the bottom of the storage container (2) and the base unit (1) and arranged to permit the storage container (2) to rotate and tip-out of the base unit (1). Pins (6) positioned along the top of the storage bin provide a means of stopping the rotation of the storage bin (2) and prevent the storage bin (2) from tipping out of the base unit (1). A fitting (9) having an internal surface and a flange is positioned in an opening in the top such that the flange rests on and is attached to the top surface of the base unit (1). A tube (13) with a plurality of holes (18) is placed in a vertical position inside the fitting (9). Optionally the tube (13) can be constructed to two telescoping members so that the length can be varied. A frame (11) with a plurality of hooks (12) is attached to the opposite end of the tube (13) such that its vertical height is adjustable. The hooks (12) can be of various sizes and shapes to hold a variety of different items. A plurality of bars (17) are arranged in the open side of the base unit (1) for the storage of foot wear. Wheeled casters (16) are attached to the bottom of the base unit (1).

Figures 3, 3A:
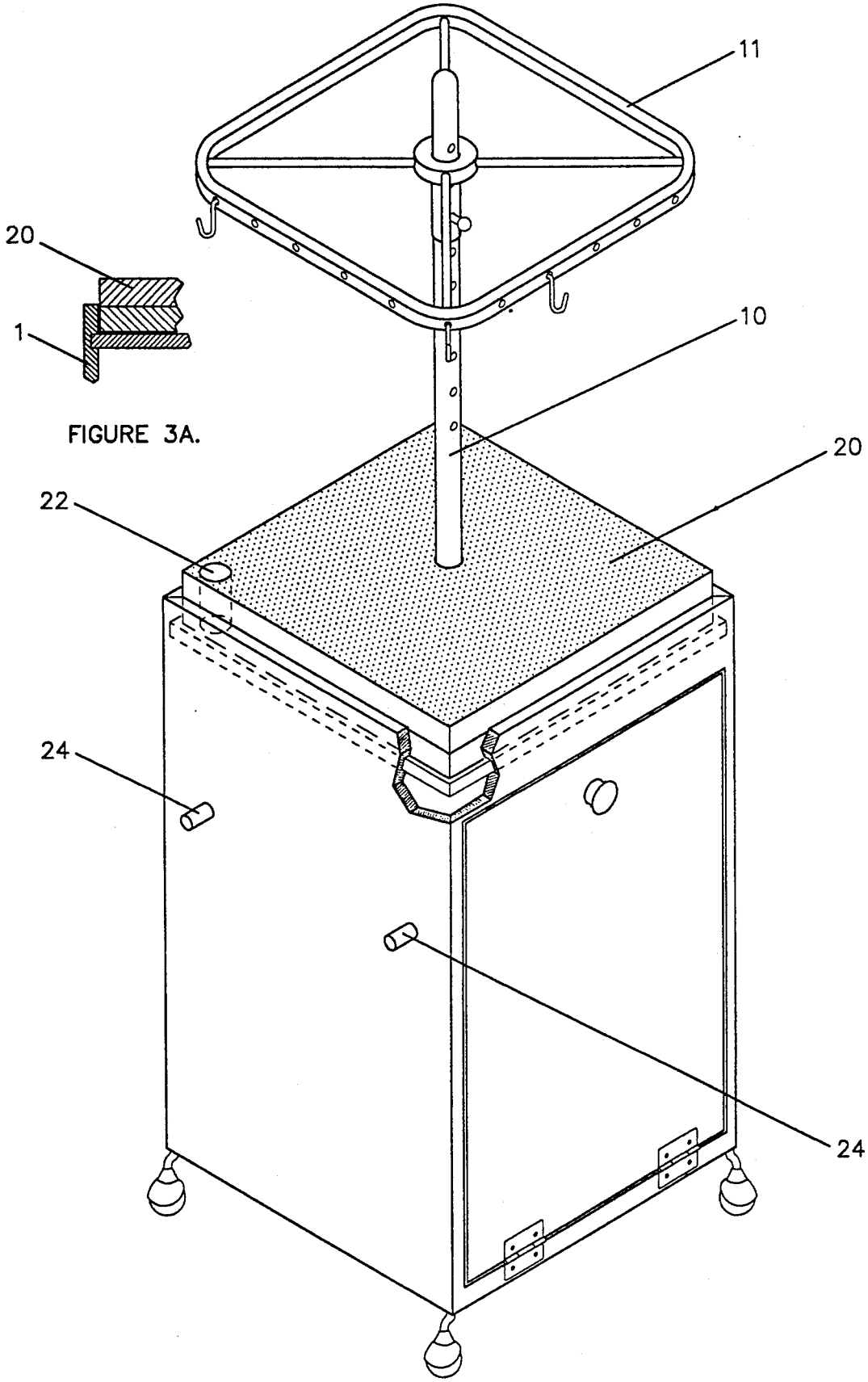
FIG. 3 is a perspective view showing the device with the two sided removable work surface.
FIG. 3*a* is a fragmentary cross-sectional view of the top resting on the base unit.

FIG. 3 shows the device in a perspective view with the removable two sided top (20) resting on the top surface of the base unit (1). The top (20) can have a different type surface on each side, such as a cutting board on one side and soft resilient surface on the other. A hole (22) is in one corner of the top (20) and a corresponding hole is in the base unit (1). This hole allows the tube (10) to be stored within the base unit with only the end of it protruding. On the one side of the base unit (1) are a pair of storage pins (24) used to store the frame (11) when it is not in use.

FIG. 3*a* is a fragmentary cross sectional view of the base unit (1) and the top (20).

Figure 4:
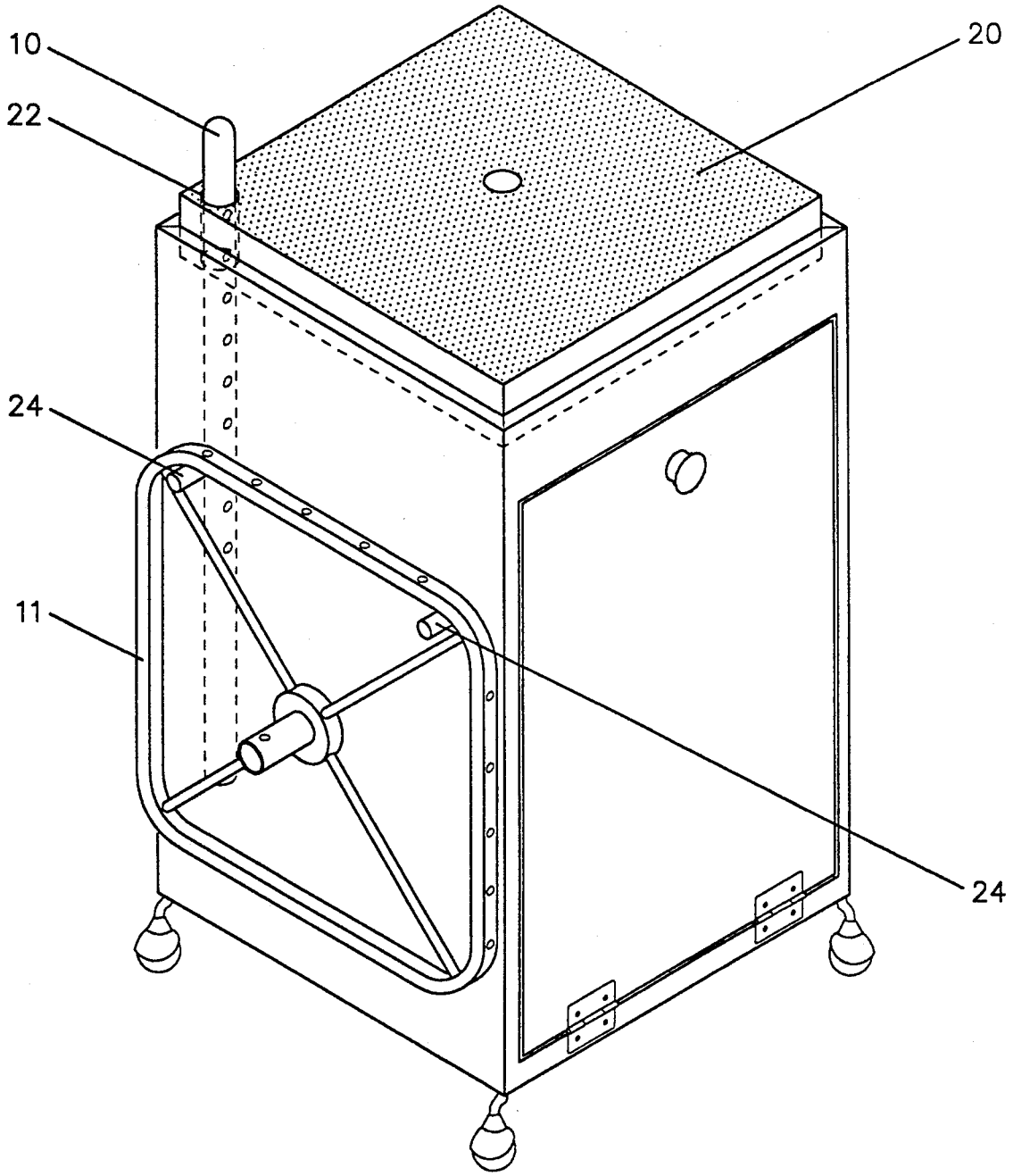
FIG. 4 is a perspective view showing the device with the rectangular frame stored on the side of the base unit.

FIG. 4 shows the device in a perspective view with the removable two sided top (20) resting on the top surface of the base unit (1), the frame (11) stored on the storage pins (24) and the tube (10) stored in the hole (22).

I claim:

1. A device for the storage and organization of household articles comprising:

base unit consisting of a top having an opening in the center, a bottom parallel to said top, and four sides, said sides being perpendicular to said top and bottom, and each side being perpendicular to two sides and parallel with one side, and two opposite sides being solid and two adjacent sides having openings of varying sizes;

a storage bin having four sides each side being perpendicular to two sides and parallel with one side and a bottom which is perpendicular to the four sides, said storage bin is positioned in one of the openings in the side of the base unit;

a plurality of hinges located along the side of the storage bin and arranged to permit the storage bin to tip-out from the opening in the side of the base unit;

a means to stopping the storage bin from tipping completely out of the base unit;

a fitting set into the opening of the top surface said fitting having an internal circular opening and a flange which rests on the top of the base unit;

a tube having top and bottom ends, length and an outside diameter slightly smaller than the inside circular opening in the fitting, said tube containing a plurality of holes along the length of the tube said holes are perpendicular to the length of the tube;

a frame having a plurality of hooks is attached to the top end of the tube;

a pin which is inserted in the holes in the tube and adjusts the location of the frame along the tube;

a plurality of bars arranged in the opening in the side of the base unit opposite the opening containing the storage bin, said bars positioned at different elevations in relation to the bottom of the base unit allowing for the storage of foot wear articles.

2. The same device as in claim 1 wherein the position of the tube within the fitting is adjusted by inserting a pin in the holes in the tube.

3. The same device as in claim 1 wherein the four sides of the base unit extend above the surface of the top of the base unit forming a lip to prevent objects from rolling or falling off the top of the base unit.

4. The same device as in claim 1 wherein top of the base is a removable two-sided top.

5. The same device as in claim 1 wherein a plurality of storage pins protrude from the side of the base unit for the storage of the frame.

* * * * *